US009726455B2

(12) United States Patent
Ngeyi

(10) Patent No.: US 9,726,455 B2
(45) Date of Patent: Aug. 8, 2017

(54) PERSONAL SELF-DEFENSE DEVICE

(71) Applicant: Stanley Ngeyi, Ypsilanti, MI (US)

(72) Inventor: Stanley Ngeyi, Ypsilanti, MI (US)

( * ) Notice: Subject to any disclaimer, the term of this patent is extended or adjusted under 35 U.S.C. 154(b) by 0 days.

(21) Appl. No.: 15/291,130

(22) Filed: Oct. 12, 2016

(65) Prior Publication Data

US 2017/0102206 A1 Apr. 13, 2017

Related U.S. Application Data

(60) Provisional application No. 62/240,034, filed on Oct. 12, 2015.

(51) Int. Cl.
*F41B 7/00* (2006.01)
*F41F 1/00* (2006.01)

(52) U.S. Cl.
CPC ..... *F41B 7/00* (2013.01); *F41B 7/003* (2013.01); *F41F 1/00* (2013.01)

(58) Field of Classification Search
CPC .... F41B 7/00; F41B 7/003; F41B 7/04; F41B 7/08
See application file for complete search history.

(56) References Cited

U.S. PATENT DOCUMENTS 281,455 A * 7/1883 Clark ..... F41B 7/003 124/2
1,741,902 A 12/1929 Alden
1,760,674 A 9/1930 Von Frantzius
2,600,883 A * 6/1952 King ..... F41B 7/00 124/16
3,824,727 A 7/1974 Hudson
4,565,183 A * 1/1986 Smith ..... F42B 12/40 124/26
5,456,036 A * 10/1995 Butz ..... A01M 31/008 124/26
5,979,424 A * 11/1999 Alvarez ..... F41B 7/08 124/16
6,669,530 B2 * 12/2003 Du ..... A63H 37/00 124/16
7,163,515 B2 1/2007 McNenny
7,448,371 B2 11/2008 Sapir

* cited by examiner

*Primary Examiner* — John Ricci
(74) *Attorney, Agent, or Firm* — The Weintraub Group, P.L.C.

(57) ABSTRACT

An arming assembly for a personal self-defense device includes a substantially closed-ended cylindrical member having a first end and a second end, the cylindrical member having an interior chamber. At least one opening being formed within the first end for the inserting and exiting of a porcupine quill. A translatable piston includes a spring and a disc being disposed within the interior chamber. At least one arm being attached to the spring in order to compress and release the spring and translate the disc toward the second end. At least one quill is inserted into the opening formed within the first end and sits in an associated indentation formed within the disc. Once the arm is released, the quill is projected forward and exits through the opening formed within the first end, which is aimed at a would-be attacker. The arming assembly may be double-acting by having conjoined opposed similar components.

19 Claims, 3 Drawing Sheets

PERSONAL SELF-DEFENSE DEVICE

CROSS-REFERENCE TO RELATED APPLICATION

This application is a completion application and which claims the priority benefit of U.S. Provisional Patent Application Ser. No. 62/240,034, filed Oct. 12, 2015, for "Personal Self Defense Device," the entire disclosure of which is hereby incorporated by reference in its entirety, including the drawing.

BACKGROUND OF THE INVENTION

1. Field of the Invention

The present invention pertains to personal self-defense devices. More particularly, the present invention pertains to personal self-defense devices which are useful when in close proximity to any would-be attacker. Even more particularly, the present invention pertains to such devices which emit projectiles that impact and cause pain to any would-be attacker.

2. Related Art

There are numerous methods and philosophies, techniques, equipment, teachings, and education on how to defend one's self in the face of imminent danger. Each method or philosophy has its merit, but the majority typically advocates methods that are difficult to implement and could even be detrimental to the user if improperly executed. Others are just not practical either because of inherent flaws or legal limitations.

For instance, pepper spray would act against the user if the direction of the wind suddenly changes unfavorably. A gun is not practical to carry at all times even if one has the legal permit to carry a concealed weapon. Even the best trained martial artist risks injury in a fight with the most untrained person, who may land that lucky punch that could injure an eye, a tooth, or inflict other bodily damage or even death.

The best self-defense philosophy is that which is premised on self-preservation. The best self-preservation method is an escape. Running away allows for an injury free escape from the scene of potential danger. Nevertheless, an escape is not always possible without a primary reaction to an attack or imminent danger. The question is, therefore, "what primary action is best to allow one to escape a potentially dangerous scene well enough to live to talk about it with others?"

One could choose to fight using self-defense tactics taught in numerous self-defense "schools," employ a gun, pepper spray, a Taser, and more.

The ultimate self-defense move is one which deters the potential attacker from attacking in the first place. This is where most self-defense protocols, education, or weapon systems fail; because they must be employed to accomplish one's end and, even when employed, there is no guaranty that success would be the outcome. What is the probability that one would carry one's gun in clear view of an impending attacker much like a police officer carries his/her gun? In fact, what are the chances that the first bullet would even hit its target?

It is noteworthy that an attacker plans his/her move well in advance and sometimes scouts the potential victim well enough to be confident of success. Most of the time, criminals go after the weak and defenseless people. It is no doubt that women, the elderly, children, and the sick are usually the victims of heinous crimes. They are perceived as vulnerable and, hence, easy targets.

The related art has addressed this situation by proposing a number of portable self-defense devices that project a non-lethal projectile at an assailant.

For example, U.S. Pat. No. 1,741,902 to Alden teaches a double-barrel firearm utilized in firing a non-metallic and relatively soft projectile. The firearm provides an individually operated firing mechanism within each barrel. Additionally, a cartridge full of the desired projectiles are inserted via the removable rear end of the firearm where the empty shells are removed. In practicing the firearm defined in Alden, valuable time is wasted by having to open the rear end of the firearm in order to load the cartridge.

Reissue U.S. Pat. No. 17,813 to Von Frantzius is similar to Alden in that the device disclosed therein is disguised as a pen having a slidably mounted plunger disposed therein for firing a projectile. However, Von Frantzius requires the device to be disassembled in order to load the projectile prior to firing. The time in doing so can be detrimental to the person being threatened or attacked.

U.S. Pat. No. 3,824,727 to Hudson also teaches a mini-caliber firearm for firing a projectile. The firearm provides the appearance of a pen including an elongated oval housing having a barrel fitted therein and a spring to facilitate firing of a loaded projectile through an open tip of the housing. Despite being a small and easily concealable firearm, the loading of the firearm is complicated with numerous removable pieces. It is noted that, due to the rather extensive manipulation required to accomplish the loading and cocking procedures, use of the firearm for more than one firing is not practical. Instead, the firearm is intended to be treated as a throwaway item and discarded after a single use.

U.S. Pat. No. 7,163,515 to McNenny teaches a projectile blood collection device used in obtaining a blood sample from an intruder at a crime scene to be later analyzed for DNA. The device operates by firing a needle projectile assembly at an intruder which penetrates the intruder's skin in order to collect a blood sample. Once a sufficient blood sample is collected, after approximately 1 to 2 seconds, the needle projectile assembly is propelled outwardly from the intruder so he/she cannot find or recover the blood sample taken from him/her. McNenny focuses on the needle projectile assembly and not how the needle projectile assembly is loaded into the device, nor how the needle projectile assembly is fired.

U.S. Pat. No. 7,448,371 to Sapir teaches a device for projecting a projectile generally including a projectile mount configured to hold the projectile, a housing, and a retractor. The retractor is slidably connected to the rear of the housing and connected to the projectile mount by a resilient member, such as a rubber band, spring, or the like. As the retractor is pulled rearwardly, the projectile mount is similarly translated backward. Upon releasing the retractor, the projectile mount is launched forward. Kinetic energy from the projectile mount is then transferred to a projectile situated on the projectile mount and similarly launched forward toward an attacker. The projectile taught in Sapir is not housed within the device at all and, therefore, subject to falling off or out of place while the device is being stored. Further, because the projectile is frictionally held in place on the projectile mount, kinetic energy is lost during firing.

The above U.S. patents teach various devices for firing a projectile at a would-be attacker, yet fail to describe one that can be readily armed, fired, and reloaded without substantial manipulation.

Thus, it is readily apparent that there exists a need for a re-usable and protective device that is quick to load and fire a projectile, which creates severe pain and/or immobilization to any would-be attacker, including an attacking animal to prevent any further attack.

The above patents are identified herein in recognition of a duty of disclosure of related subject matter, which may be relevant under 37 CFR 1.56, and specifically incorporated, herein by reference as regards the conventional approaches and constructions taught therein.

SUMMARY OF THE INVENTION

The present invention provides, in a first aspect, an arming assembly for a personal self-defense device and, in a second aspect, the present invention provides a personal self-defense device employing the arming assembly. The arming assembly comprises: (a) a substantially closed-ended member having a first end and a second end, the member having an interior chamber, at least one opening formed within the first end for the inserting and exiting of a projectile, at least one slot formed along a side of the member; (b) a translatable piston disposed within the interior chamber, the piston including means for biasing and a disc, the disc having at least one indentation or seat for receiving an end of the projectile, the at least one indentation being in registry with the at least one opening; (c) at least one tube extending inwardly from the at least one opening toward the second end, the at least one tube defining a stabilizer for the projectile; and (d) at least one arm attached to the means for biasing and extending outwardly from the member through the at least one slot, the means for biasing being compressed when the at least one arm is actuated in a first direction and the means for biasing being released when the at least one arm is actuated in a second direction.

The arming assembly is intended to project at least one porcupine quill at a would-be attacker. In use, a porcupine quill is inserted into the opening formed in the first end of the member and sits within an associated indentation formed in the disc. Thereafter, the user retracts the arm backward toward the second end to compress the means for biasing, thereby pulling the disc and porcupine quill toward the second end. Upon releasing the arm, the means for biasing and the disc are released from their cocked position and the porcupine quill is deployed through the opening in the first end, which is aimed at the attacker.

When the quills are loaded into the arming assembly there is defined a personal self-defense device.

For a better understanding of the present invention, reference is made to the accompanying drawing and detailed description. In the drawing, like reference numerals refer to like parts through the several views, in which:

DETAILED DESCRIPTION OF THE INVENTION

The present invention provides, in a first aspect, an arming assembly for a personal self-defense device and, in a second aspect, the present invention provides a personal self-defense device employing the arming assembly and comprising at least one projectile. As noted below, once at least one projectile is loaded into the arming assembly, the arming assembly in combination with the projectile defines the self-defense device.

Figure 1:
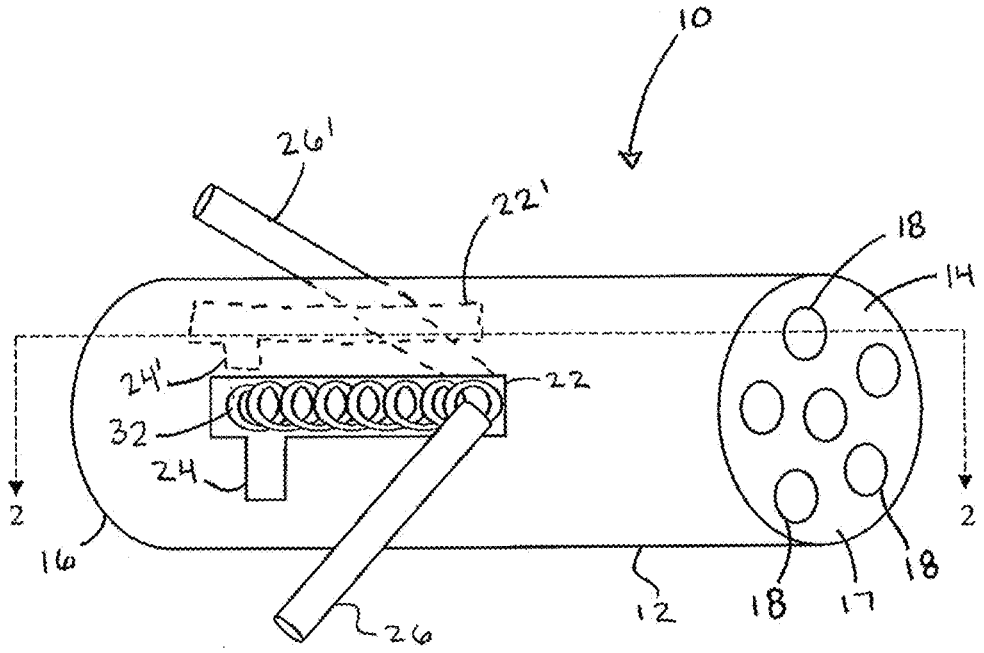
FIG. 1 is a perspective view of a first embodiment of the device hereof.
Figure 2:
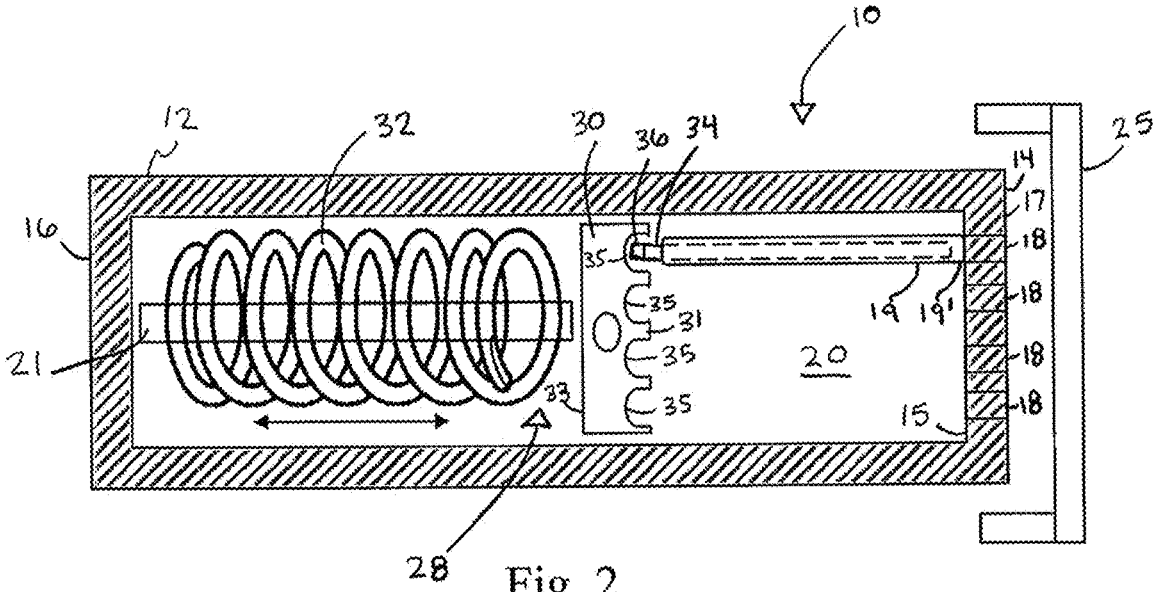
FIG. 2 is a cross-sectional view of the first embodiment of the device hereof taken along line 2-2 of FIG. 1.

Now, and with reference to the drawing and, in particular FIGS. 1 and 2, the second aspect of the present invention provides the personal self-defense device, denoted at 10, generally, comprising a substantially closed-ended cylindrical member 12 having a first end 14 and an opposed second end 16. The first end 14 has an interior side or surface 15 and an exterior side or surface 17. The cylindrical member 12 has an interior chamber 20.

A series of openings 18 is formed in the first end 14 which defines access openings for projectiles, as discussed below.

At least one and, preferably, a plurality of cylindrical tubes 19 (only one of which is shown) is disposed on the interior side 15 of the first end 14. Each tube 19 is in registry with an associated opening 18. The tubes 19 extend into the interior chamber 20 of the cylindrical member 12 and define stabilizers for the projectiles, as described below.

Each tube 19 has a first end 19' fixedly secured about the perimeter of its associated opening 18, depending on the material of construction, such as by welding, sonic welding, bonding, or the like.

As shown, a piston or plunger 28 is disposed within the interior chamber 20 of the cylindrical member 12 and comprises a disc 30 and means for biasing, such as a spring 32 connected thereto.

The disc 30 is slidable or translatable within the interior chamber 20. The disc 30 includes a front surface 31 and a rear surface 33.

The front surface 31 of the disc 30 preferably has a plurality of indentations or seats 35, which define projectile seats.

Optionally, a shaft 21 may extend laterally outwardly from the rear surface 31 of the disc 30 toward the second end 16.

The spring 32 is disposed between the second end 16 and the disc 30 and normally urges the disc 30 toward the first end 14. The spring 32 is connected to the rear surface 31 of the disc 30 such that movement of the disc 30 and spring 32 toward the rear end 16 compresses the spring 32.

As shown, the cylindrical member 12, also, includes a first slot 22 formed along the extent thereof. A first cut-out 24 is formed normal to the first slot 22 in the cylindrical member 12. Opposite the first slot 22, a second slot 22' is formed along the extent of the cylindrical member 12 similar to that of the first slot 22. A complementary second cut-out 24' similar to cut-out 24 is provided normal to the second slot 22'.

A first arm 26 is secured to the spring 32 and defines means for arming the device 10. The first arm 26 extends through the first slot 22. A second arm 26' extends through the second slot 22' and is affixed to the spring 32 as discussed below. When armed, both arms 26, 26' are seated in their respective cut-outs 24, 24' in diametric opposition thereto.

The arm(s) 26, 26' are used to compress the spring 32 and retract the disc 30 by drawing the arm(s) 26, 26' back, in a first direction, toward the second end 16 along the first slot 22 and the second slot 22', respectively. The arm(s) 26, 26' is/are then seated in their respective cut-out(s) 24, 24' once the spring 32 is compressed.

At least one and, preferably, a plurality of projectiles, such as porcupine quills 34, (only one of which is depicted) is housed and stored within the interior chamber 20 of the cylindrical member 12. As noted above, prior to the insertion of the projectile, the present invention merely defines an arming assembly.

Each quill 34 has a first end 36 seated on the disc 30, within an associated indentation 35, and extends proximate to an associated opening 18 within an associated tube 19.

In loading the present device 10, the quills 34 are inserted through an associated opening 18 and through the opening's allied or associated tube 19. Each quill 34 is substantially terminus with its associated opening 18 when the piston 28 is armed.

Figure 5:
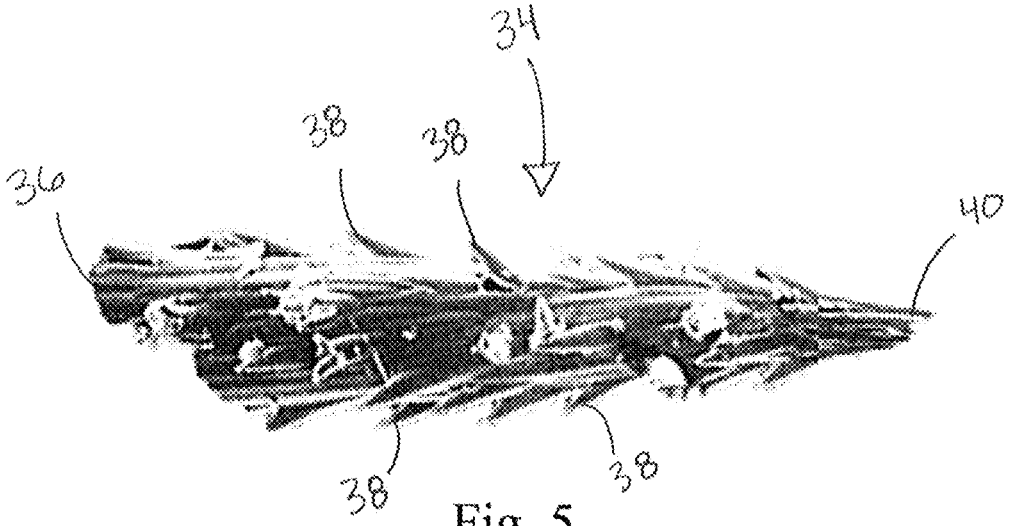
FIG. 5 is a side view of a barbed porcupine quill to be used in accordance with the present invention.

As shown in FIG. 5, the utilization of porcupine quills 34, which can be either natural porcupine quills or synthetically manufactured, is critical to the practice hereto. As is known to those familiar with the biology of porcupine quills, porcupine quills 34 have a plurality of circumferential rearward facing barbs 38 which prevent an assailant or attacker from pulling the quill 34 out of his, her, or its body. Additionally, porcupine quills 34 have a pointed tip 40 for easy entry into the body of an assailant as well as loading into the device 10. This structure serves two purposes. First, they stabilize the quills 34 when in flight toward the attacker and, second, once they penetrate the skin of any object, they are hard to pull out. In fact, this will cause excessive pain should one want to pull them out. Thus, the attacker becomes immobilized.

To deploy the present device 10, the spring 32 is armed and, thereafter, a plurality of porcupine quills 34 is inserted into the interior chamber 20 of the cylindrical device 12 via their associated openings 18 and tubes 19, and seated in respective seats or indentations 35. Because the size of each of the quills 34 is substantially equal in length and diameter to the openings 18 when the spring 32 is compressed, the quills 34 are retained within their tubes 19 and do not become dislodged.

Additionally, a removable cap 25, may be fitted over the first end 14 to retain the quills 34 in position until released.

In the event of an attack, the user removes the cap 25, if present, and urges the arm(s) 26, 26' out of its/their respective cut-out 24, 24' thereby releasing the arm(s) 26, 26' forward in a second direction. The spring 32 is released and the expelled force urges the disc 30 toward the front end 14, thereby ejecting and shooting the quills 34 at any would-be attacker. Typically, the quills 34 may travel a distance of from about nine (9) feet to about twenty (20) feet to define a stop zone. Such a stop zone ordinarily provides a sufficient safe perimeter for the user to escape the attacker.

Figure 3:
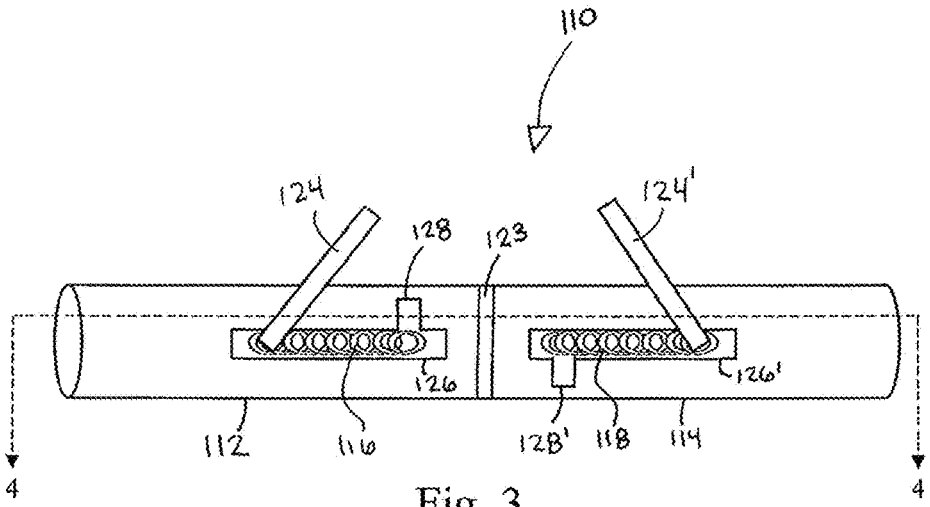
FIG. 3 is a perspective view of a second embodiment of the device hereof.
Figure 4:
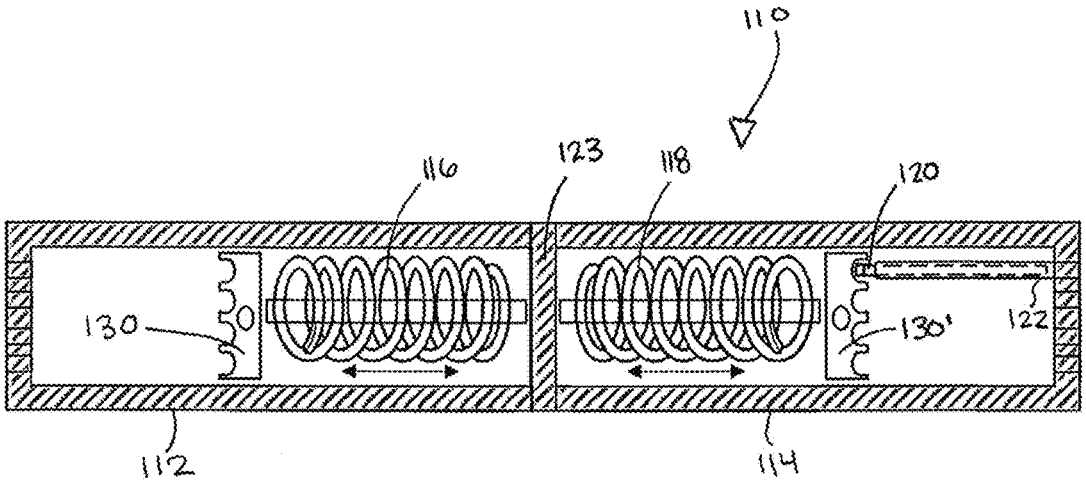
FIG. 4 is a cross-sectional view of the second embodiment of the device hereof taken along line 4-4 of FIG. 3.

As shown in FIGS. 3 and 4, there is depicted an alternate or second embodiment herein, wherein the device is a double-acting device, generally, denoted at 110. Here, the device 110 has a pair of opposed cylindrical members 112, 114, each including means for biasing 116, 118, a disc 130, 130', and tubes 122 (only one of which is shown) for stabilizing an associated quill 120. The double action enables a potential victim to turn the device 110 around for a second use if the first shooting fails to stop an attacker.

A dividing wall 123 separates or divides the device 110 into separate projectors. Arms 124, 124', cut-outs 126, 126', slots 128, 128', etc. operate in substantially the same way as discussed above with regards to the first embodiment. While only two arms 124, 124', cut-outs 126, 126', and slots 128, 128' are shown, one on each cylindrical member 112, 114, a pair of each may be provided on each cylindrical member 112, 114.

In fabricating the device, preferably, it is fabricated from any light weight metal, such as aluminum or the like, or molded from a suitable plastic, and is dimensioned to fit in the palm of the user. It may be brightly colored to make it readily visible to both the user and to act as a warning to any would-be assailant.

When made of plastic, the tubes can be molded with or sonically welded or bonded to the first end, which can then be press fitted to the cylindrical member as a unitary assembly. When made of metal, the tubes can be welded to the cylindrical member.

In addition, the device, which can be carried on a purse, key chain, or the like, may have accessories associated therewith, such as a knife which can be disposed in a carrying case, pocket, or the like via eyelets or similar loops affixed to the exterior of the cylindrical member.

From the above it is apparent that the present invention provides a device that can readily repel and/or deter a would-be attacker.

LIST OF REFERENCE NUMBERS

10 Self-defense device
12 Cylindrical member
14 First end of cylindrical member
15 Interior side of first end
16 Second end of cylindrical member
17 Exterior side of first end
18 Openings
19 Cylindrical tubes
19' First end of cylindrical tube
20 Interior chamber of cylindrical member
21 Shaft
22 First slot of cylindrical member
22' Second slot of cylindrical member
24 First cut-out
24' Second cut-out
25 Removable cap
26 First arm
26' Second arm
28 Piston
30 Disc
31 Front surface of disc
32 Spring
33 Rear surface of disc
34 Quill
35 Indentations of disc
36 First end of quill
38 Barbs of quill
40 Pointed tip of quill
110 Double-acting device
112 Cylindrical member
114 Cylindrical member
116 Means for biasing
118 Means for biasing
120 Quills
122 Tubes
123 Dividing wall
124 Arm
124' Arm
126 Cut-out
126' Cut-out
128 Slot
128' Slot
130 Disc
130' Disc Having described the invention, which is claimed is:

1. An arming assembly for a personal self-defense device comprising:

(a) a substantially closed-ended member having a first end and a second end, the member having an interior chamber, at least one opening formed within the first end for the inserting and exiting of a projectile, at least one slot formed along a side of the member;

(b) a translatable piston disposed within the interior chamber, the piston including means for biasing and a disc, the disc being attached to the means for biasing, the disc having at least one indentation for receiving an end of the projectile, the at least one indentation being in registry with the at least one opening;

(c) at least one tube extending inwardly from the at least one opening toward the second end, the at least one tube defining a stabilizer for the projectile; and (d) at least one arm attached to the means for biasing and extending outwardly from the member through the at least one slot, the means for biasing being compressed when the at least one arm is actuated in a first direction and the means for biasing being released when the at least one arm is actuated in a second direction.

2. The arming assembly of claim 1 wherein the projectile is a porcupine quill.

3. The arming assembly of claim 2 wherein the first end of the closed-ended member includes a plurality of openings formed therein.

4. The arming assembly of claim 3 wherein the disc includes a plurality of indentations, each of the plurality of indentations being in registry with an associated one of the plurality of openings.

5. The arming assembly of claim 4 further comprising: a plurality of tubes, each of the plurality of tubes extending inwardly from an associated one of the plurality of openings toward an associated one of the plurality of indentations.

6. The arming assembly of claim 2 further comprising: a pair of slots formed along opposite sides of the member.

7. The arming assembly of claim 6 further comprising: a pair of arms, each arm connected to the means for biasing and extending outwardly from the interior chamber through an associated one of the pair of slots.

8. The arming assembly of claim 7 further comprising: a cut-out formed within and normal to each one of the pair of slots, each arm being locked in place as it retracts and is positioned within a respective cut-out.

9. The arming assembly of claim 2 wherein the means for biasing is a spring.

10. The arming assembly of claim 2 further comprising: a removable cap, the cap being removably fitted over the first end of the member in order to retain the projectile in position until released.

11. The arming assembly of claim 2 further comprising: a second of such arming assembly disposed with and in opposed relation with the arming assembly, each arming assembly being identical in structure.

12. The arming assembly of claim 11 wherein each closed-ended member includes a plurality of openings formed therein.

13. The arming assembly of claim 12 wherein each disc includes a plurality of indentations, each of the plurality of indentations being in registry with an associated one of the plurality of openings.

14. The arming assembly of claim 13 further comprising: a plurality of tubes, each of the plurality of tubes extending inwardly from an associated one of the plurality of openings toward an associated one of the plurality of indentations.

15. The arming assembly of claim 11 further comprising: a pair of slots formed along opposite sides of each closed-ended member.

16. The arming assembly of claim 15 further comprising: a plurality of arms, each one of the plurality of arms being connected to an associated means for biasing and extending outwardly from an associated interior chamber through an associated one of the pair of slots.

17. A personal self-defense device comprising:

(a) at least one projectile;

(b) a substantially closed-ended member having a first end and a second end, the member having an interior chamber, at least one opening formed within the first end for the inserting and exiting of the at least one projectile, at least one slot formed along a side of the member;

(c) a translatable piston disposed within the interior chamber, the piston including means for biasing and a disc, the disc being attached to the means for biasing, the disc having at least one indentation for receiving an end of the at least one projectile, the at least one indentation being in registry with the at least one opening;

(d) at least one tube extending inwardly from the at least one opening toward the second end, the at least one tube defining a stabilizer for the at least one projectile;

(e) at least one arm attached to the means for biasing and extending outwardly from the member through the at least one slot, the means for biasing being compressed when the at least one arm is actuated in a first direction and the means for biasing being released when the at least one arm is actuated in a second direction; and wherein the device defines a first personal self-defense device.

18. The first personal self-defense device of claim 17 wherein the at least one projectile is a porcupine quill.

19. The first personal self-defense device of claim 18 further comprising: a second personal self-defense device integral with and in opposed relation with the first personal self-defense device, each personal self-defense device being identical in structure.

* * * * *